United States Patent [19]

Bull

[11] Patent Number: 4,830,362

[45] Date of Patent: May 16, 1989

[54] FULL BODY, SHOCK-FREE AEROBIC AND ANAEROBIC EXERCISING MACHINE FOR USE IN THE STANDING POSITION

[76] Inventor: John W. Bull, 2 Viento, Irvine, Calif. 92720

[21] Appl. No.: 181,302

[22] Filed: Apr. 13, 1988

[51] Int. Cl.[4] ..... A63B 23/04

[52] U.S. Cl. ..... 272/70; 272/130

[58] Field of Search ..... 272/70, 71, 73, 96, 272/97, 69, 130, 72

[56] References Cited

U.S. PATENT DOCUMENTS

| | | | |
|---|---|---|---|
| 326,247 | 9/1885 | Root . | |
| 1,176,365 | 3/1916 | Hartnett . | |
| 1,521,487 | 12/1924 | Turner . | |
| 2,079,594 | 5/1937 | Clem . | |
| 2,253,996 | 8/1941 | Bechman . | |
| 2,969,060 | 1/1961 | Swanda et al. . | |
| 3,381,958 | 5/1968 | Gulland | 272/69 |
| 3,495,824 | 2/1970 | Cuinier . | |
| 3,511,500 | 5/1970 | Dunn . | |
| 3,529,474 | 9/1970 | Olson et al. . | |
| 3,566,861 | 3/1971 | Weiss | 272/96 |
| 3,582,069 | 6/1971 | Flick et al. . | |
| 3,587,319 | 6/1971 | Andrews . | |
| 3,628,791 | 12/1971 | Garcia . | |
| 3,747,924 | 7/1973 | Champoux . | |
| 3,758,112 | 9/1973 | Crum et al. . | |
| 3,759,511 | 9/1973 | Zinkin et al. . | |
| 3,792,860 | 2/1974 | Selnes | 272/70 |
| 3,970,302 | 7/1976 | Mcfee . | |
| 3,976,058 | 8/1976 | Tidwell . | |
| 4,188,030 | 2/1980 | Hooper | 272/73 |
| 4,550,908 | 11/1985 | Dixon . | |
| 4,563,001 | 1/1986 | Terauds | 272/72 |
| 4,600,187 | 7/1986 | Schenker . | |
| 4,632,385 | 12/1986 | Geraci | 272/70 |

FOREIGN PATENT DOCUMENTS 593703 1/1978 U.S.S.R. .

*Primary Examiner*—Richard J. Apley
*Assistant Examiner*—J. Welsh
*Attorney, Agent, or Firm*—F. Eugene Logan

[57] ABSTRACT

In a preferred embodiment the full body, shock-free exercising machine of this invention comprises a base member; a vertical frame member fixedly attached to the base member, right and left lower levers pivotally mounted on the lower part of the vertical frame member, the free ends thereof being operable for standing on by users; right and left upper levers pivotally mounted on the upper part of the vertical frame member; right and left tie rods pivotally mounted at the upper distal ends thereof to the right and left upper levers, respectively, and pivotally mounted at the lower distal ends thereof to the right and left lower levers, respectively, such that rotation of the lower lever on either side of said machine in one direction causes rotation of the upper levers on the same side of the machine in an opposite direction rocker arm for synchronizing the movement of the lower levers, the rocker arm being operable when one of the lower levers is moving downwardly to cause the other one of the lower levers to move upwardly; and shock-free resistance system for resisting the movement of the right and left lower levers.

20 Claims, 9 Drawing Sheets

114
104
110
36
90
52
86
88

86
36
52
100
104
96
44
24
84
44
94
98
48
142
92

FULL BODY, SHOCK-FREE AEROBIC AND ANAEROBIC EXERCISING MACHINE FOR USE IN THE STANDING POSITION

BACKGROUND OF THE INVENTION

1. Field of the Invention

The present invention relates to aerobic and anaerobic exercise equipment. More particularly, the invention concerns conditioning apparatus for shock-free exercising the full body, that is the upper and lower body simultaneously.

2. Discussion of the Invention

Walking and jogging have been traditional forms of aerobic exercise and weight lifting a traditional form of anaerobic exercise. The traditional form of weight lifting which requires barbells or complex machines with chains and weights, are not usually used for aerobic conditioning. In recent years, aerobic conditioning has become increasingly popular as evidenced by membership clubs providing supervised aerobic classes.

As jogging has become more popular the medical profession has noticed an increase of impact related injuries to the back, legs, feet and joints. To a lesser extent, regular walking has also contributed to these types of injuries. Those active in sports medicine generally agree that long-term jogging and walking, particularly on hard surfaces without proper equipment can result in serious debilitating injuries.

In addition to jogging and walking which require relatively little expense for equipment, bicycling, tennis, handball, squash and similar sports are also a popular form of exercise particularly for the legs and lower body. Unfortunately, all of these sports can cause serious bodily injury if one is not careful. Furthermore, many of these sports require expensive special facilities and if practiced in indoor facilities to avoid the uncertainties of the weather, become even more expensive.

In an attempt to overcome the drawbacks of jogging, several manufacturers have produced elaborate types of treadmill-type apparatus. Such apparatuses basically exercise only the lower body and are typically quite expensive and often cumbersome and noisy to use. Maintenance costs for such equipment can be high and considerable space is often required for the equipment. Further, treadmill apparatus can be dangerous to use and falls can occur with treadmills.

An example of treadmill-like device with moving steps on a ramp is disclosed in U.S. Pat. No. 3,970,302, which also discloses an alternate device with pivotally mounted foot support members. U.S. Pat. No. 3,970,302 is hereby incorporated herein by reference. Unfortunately, the exercising machines disclosed do not exercise the entire body and therefore cannot be considered as full body exercising devices.

Swimming is, of course, a well known and a popular form of full-body, shock-free exercise and is generally considered safer and far more beneficial than the above mentioned sports. Unfortunately, costly, special facilities are required and, in many parts of the country, private swimming pools are impractical due to weather considerations.

Therefore, what is needed is an exercising machine which, like swimming will exercise the entire or full body while at the same time not have the disadvantages of the above sports including the high cost, which is not weather dependent, and which does not induce shock or undue stress to the body. So that such a full body exercising machine can be enjoyed by many, it should be relatively inexpensive. So that it can be used by the apartment dweller, it should be a quiet and clean machine when used and not require weights or chains or components which require substantial amounts of grease for lubrication. Furthermore, it would be highly desirable if the full body exercising machine could be used both for aerobic or cardiovascular exercise as well as anaerobic or muscle building exercise to the extent desired by the user.

The apparatus of the present invention offers all of above mentioned advantages, requires a relatively small space so that it can be used and stored in the user's living room, and it is both relatively inexpensive to manufacture and maintain. In fact, the exercising machine of this invention is virtually maintenance free.

SUMMARY OF THE INVENTION

It is an object of this invention to provide an exercising machine for the full body or entire exercise of the human body.

It is an object of this invention to provide an exercising machine which can be used for both aerobic and anaerobic exercising.

It is another object of the invention to provide an exercising machine which is safe to use by one inexperienced in aerobic or anaerobic exercises.

Another object of the invention is to provide an exercising machine in which the full body exercise is completed in a smooth, shock-free manner with minimum impact stress exerted on the muscles and joints of the user's body.

It is a further object of this invention to provide an exercising machine in which at all times the user remains in an upright standing position.

Yet another object of this invention is to provide an exercising machine which combines a push and pull motion of the arms in a front to back to front arm movement with simultaneous and synchronized climbing motion of the legs.

Still another object of this invention is to provide an exercising machine in which at the end of a cycle the limbs on one side of the user's body are straight with the arm extended straightly in front and the leg extended straightly down while the user's limbs on the user's other side are bent at least about a right angle at the elbow and knee.

A further object of this invention is to provide an exercising machine in which the user's limbs on one side of the user's body are straightening and approaching full limb extension while the user's limbs on the user's other side are bending and approaching a bend of at least about a right angle, relative to fully extended or straight position, at the elbow and knee.

Still another object of this invention is to provide an exercising machine which when used over several cycles will induce a natural rhythmic motion to the human body by causing an oscillatory motion to the spinal column, neck and head of the user while simultaneously flexing the user's arms and legs from a fully extended and straightened position to a bent orientation of at least about a right angle and while simultaneously exercising neck, spine, pelvic and ankle muscles.

Yet another object of one embodiment of this invention is to provide an exercising machine which can be used by the young or elderly, by the small or large statured person, and by the frail or strong.

Still another object of one embodiment of this invention is to provide an exercising machine in which the resistance of the machine to the exertive forces of the user can be adjusted quickly and even without dismounting from the machine by the mere adjustment of a single small needle valve or similar means.

Still a further object of this invention is to provide an exercising machine which is whisper quiet and can be used in an apartment while watching television or listening to music to lessen the boredom usually associated with exercising, without requiring the volume of such audio appliances to be increased to overcome the noise produced by the machine.

Yet another object of this invention is to produce a full body exercising machine which is completely free of chains and weights and such noises are typically produced during the use of conventional exercising machines containing chains and weights.

A further object of this invention is to produce a relatively light weight, full body exercising machine which does not require grease and is clean and attractive enough that it can remain in the bedroom or living room of the user and not be relegated to the user's garage, basement or attic because of its unattractive appearance or greasy condition.

Another object of this invention is to provide a full body exercising machine which is relatively inexpensive but exceptionally durable and maintenance free. These and other objectives and advantages will be made apparent from the following description of this invention.

Accordingly, there is provided by the principles of this invention an exercising machine having a cycle for the full body, shockfree, exercise of the human body in which at all times the user remains in an upright standing position, such full body exercise simulating climbing motion of the user's legs with synchronized push-pull motion of the user's arms, whereby at the start of the cycle with the user's body weight shifted to the right side of the machine, the user's right limbs are fully extended with the user's right arm in front of the user and at about a right angle to the user's right leg, and the user's left limbs are bent with the user's left leg being bent at the knee at least about a right angle and the user's left arm being bent at the elbow at least about a right angle, whereby shifting of the user's body weight to the left side of the machine commences bending of the user's right limbs and straightening of the user's left limbs such that at mid cycle of the machine the user's left limbs are fully extended with the user's left arm in front of the user and at about a right angle to the user's left leg, and the user's right limbs are bent with the user's right leg being bent at the knee at least about a right angle and the user's right arm being bent at the elbow at least about a right angle, whereby at mid-cycle of the machine, shifting of the user's body weight back to the right side of the machine commences bending of the user's left limbs and straightening of the user's right limbs such that at the end of the cycle of the machine the user's right limbs are fully extended with the user's right arm in front of the user and about a right angle to the user's right leg, and the user's left limbs are bent with the user's left leg being bent at the knee at least about a right angle and the user's left arm being bent at the elbow at least about a right angle.

The full body exercising machine of this invention comprises a base member operable for maintaining the machine in an upright standing position, and a vertical frame member fixedly attached to the base member proximate the rearward end thereof.

The machine further comprises right and left lower levers pivotally mounted on the lower part of the vertical frame member at a lower pivot point and horizontally and forwardly extending therefrom, the free ends of the right and left lower levers being operable for standing on by user's right and left feet, respectively, right and left upper levers means pivotally mounted on the upper part of the vertical frame member at an upper pivot point and horizontally and rearwardly extending therefrom, a portion of the right and left upper lever means serving as right and left hand grips, respectively, and right and left tie rods pivotally mounted at the upper distal ends thereof to the right and left upper lever means, respectively, and pivotally mounted at the lower distal ends thereof to the right and left lower levers, respectively, such that rotation of the lower lever on either side of the machine in one direction causes rotation of the upper lever means on the same side of the machine in an opposite direction, whereby when the free ends of either of the lower levers is at its lowest elevation, the hand grip of the upper lever means on the same side of the machine is at its farthest rearward position, and whereby when the free end of either of the lower levers is at its highest elevation, the hand grip of the upper lever means on the same side of the machine is at its farthest forward position.

The machine further comprises means of synchronizing the movement of the lower levers, the means being operable when one of the lower levers is moving downwardly to cause the other one of the lower levers to move upwardly, and when the free end of one of the lower levers is at its lowest elevation the free end of the other one of the lower levers is at its highest elevation. The distance between the free ends of the lower levers when one of the lower levers is at its lowest elevation defines a maximum step height, and the distance between the hand grips when one of the hand grips is at its farthest forward position defines a maximum hand spread. The lower levers being operable to effect a maximum step height large enough to cause one of the user's legs to be bent at the knee at least about a right angle when the other one of the user's legs is straight, and the upper lever means being operable to effect a maximum hand spread large enough to cause one of the user's arms to be bent at the elbow at least about a right angle when the other one of the user's arms is straight. The machine also comprises shock-free resistance means for resisting the movement of the right and left lower levers. Travel of the free end of one of the lower levers from its lowest elevation to its highest elevation and thence back to its lowest elevation defines a full cycle. Accordingly, when a user stands on the free ends of the lower levers and tightly grips the hand grips, while causing the machine to complete the full cycle, the user experiences a full body, shock-free exercise simulating climbing motion of the user's legs with synchronized push-pull motion of the user's arms.

In one embodiment of this invention, the right and left upper lever means comprises right and left upper levers pivotally mounted on the upper part of the vertical frame member at an upper pivot point and horizontally and rearwardly extending therefrom; and right and left handle bars fixedly mounted on the right and left upper levers, respectively, the handle bars extending vertically from the upper levers, the free ends of the right and left handle bars being operable for being tightly gripped by an user's right and left hands, respectively, whereby when the free ends of either of the lower levers is at its lowest elevation, the free end of the handle bar on the same side of the machine is at its farthest rearward position, and whereby when the free end of either of the lower levers is at its highest elevation, the free end of the handle bar on the same side of the machine is at its farthest forward position.

In one embodiment of this invention, the maximum step height is at least about 25 centimeters and the maximum hand spread is at least about 50 centimeters.

In another embodiment, the synchronizing means is adjustable and operable for varying the maximum step height. In a further embodiment, the synchronizing means comprises a rocker arm and right and left linking rods, the rocker arm has right and left ends and is pivotally mounted at its center to the vertical frame member thereby enabling the rocker arm to rotate in a traverse plane which is approximately vertical, the right linking rod has one end pivotally mounted to the right lower lever and an opposite end pivotally mounted to the right end of the rocker arm, and the left linking rod has one end pivotally mounted to the left lower lever and an opposite end pivotally mounted to the left end of the rocker arm. In a still further embodiment, the linking rods have an effective length which can be adjusted to predetermined values thereby enabling the maximum step height to be adjusted to corresponding predetermined values corresponding to the height and stamina of the user.

In another embodiment of this invention, the resistance means for resisting the movement of the right and left lower levers, has one end of the resistance means pivotally mounted on the upper part of the vertical frame member and another end of the resistance means being pivotally mounted on one of the lower levers.

In yet another embodiment of this invention, the resistance means is adjustable and operable for varying the force required to move the lower levers.

In still another embodiment of this invention, the resistance means comprises hydraulic cylinder having a slidable piston therein connected to a piston rod, the piston dividing the hydraulic cylinder into an internal upper zone above the piston and an internal lower zone below the piston, and a conduit containing a flow restrictor, the conduit providing fluid communication between the upper and lower zones of the hydraulic cylinder, the external end of the piston rod being one end of the resistance means and the external end of the hydraulic cylinder opposite the piston rod being an opposite end of the resistance means. In a further embodiment the piston rod extends through both ends of the cylinder thereby insuring that the volume displaced on one side of piston equals the volume increase on the other side of the piston. In a yet another embodiment, the flow restrictor is adjustable and operable for varying the force required to move the lower levers. In a still further embodiment, the flow restrictor is a needle valve.

DESCRIPTION OF THE PREFERRED EMBODIMENT

Figure 1:
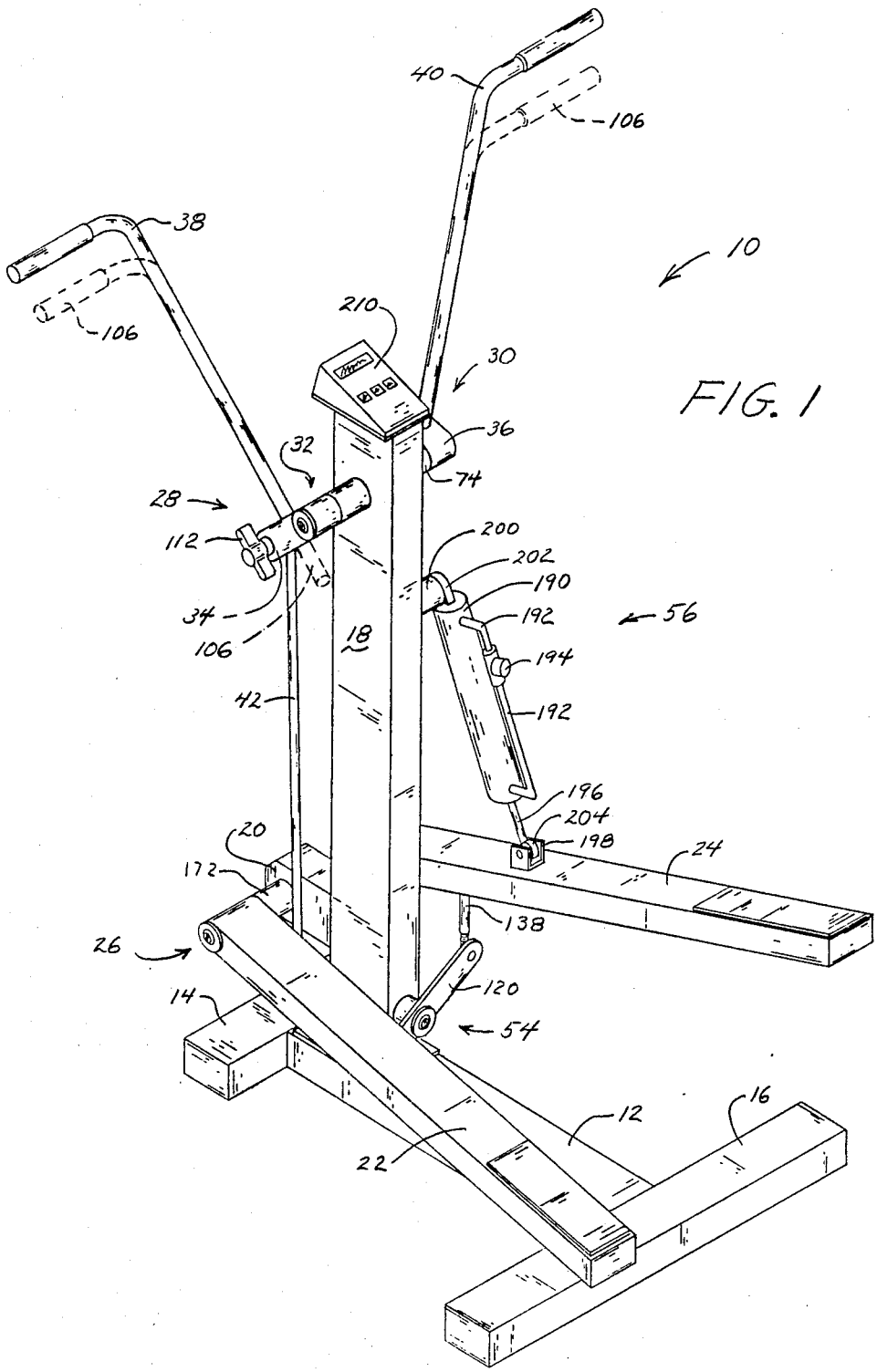
FIG. 1 is a top, front and right perspective of the exercising machine of this invention.
Figure 2:
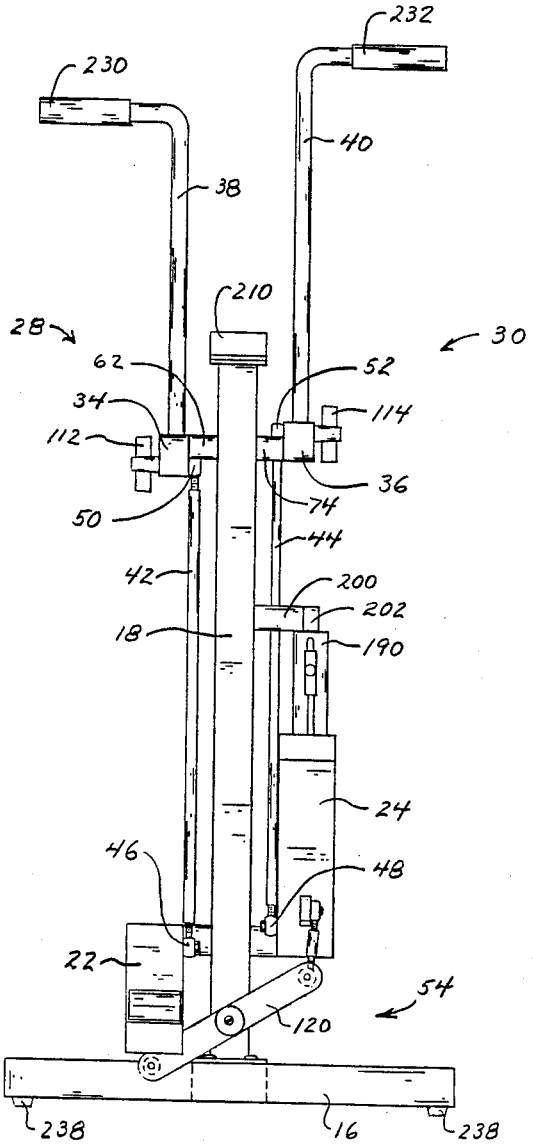
FIG. 2 is a front elevational view of the machine of FIG. 1.

A full body exercising machine of this invention is indicated generally by reference numeral 10 of FIG. 1. The machine comprises longitudinal base frame member 12 rigidly fastened to rear and front traverse base frame members 14 and 16, respectively, which provide lateral stabilization of the machine when it is in use. Referring to FIGS. 1 to 4, also rigidly fastened to member 12 is upstanding frame member 18 to which is rigidly fastened to extension frame member 20. Machine 10 further comprises left and right lower levers 24 and 26, respectively, pivotally mounted to frame member 20 by lower lever pivot means 26, and opposing left and right upper lever means 28 and 30, respectively, pivotally mounted to frame member 18 by upper lever pivot means 32. Left upper lever means 28 comprises left upper lever 34 and left handle bar 38. Similarly, right upper lever means 30 comprises right upper lever 36 and right handle bar 40. The free ends of handles bars 38 an 40 are preferably bent outwardly at approximately a right angle to facilitate hand gripping by the user.

synchronized movement of left lower lever 22 and left upper means 28 is accomplished by left tie rod 42 which is pivotally mounted to lower and upper levers 22 and 34 by lower and upper tie rod ball joints 46 and 50, respectively. Similarly synchronized movement of right lower lever 24 and right upper means 30 is accomplished by right tie rod 44 which is pivotally mounted to lower and upper levers 24 and 36 by lower and upper tie rod ball joints 48 and 52, respectively.

Synchronized movement between right and left sides of machine 10 is accomplished by right to left side synchronization means 54. Use of machine 10 without reaction resistance would do little to improve the body tonal quality of the user. Accordingly the machine also comprises resistance means 56. Means 54 and 56 will be described in greater detail later.

Figure 3:
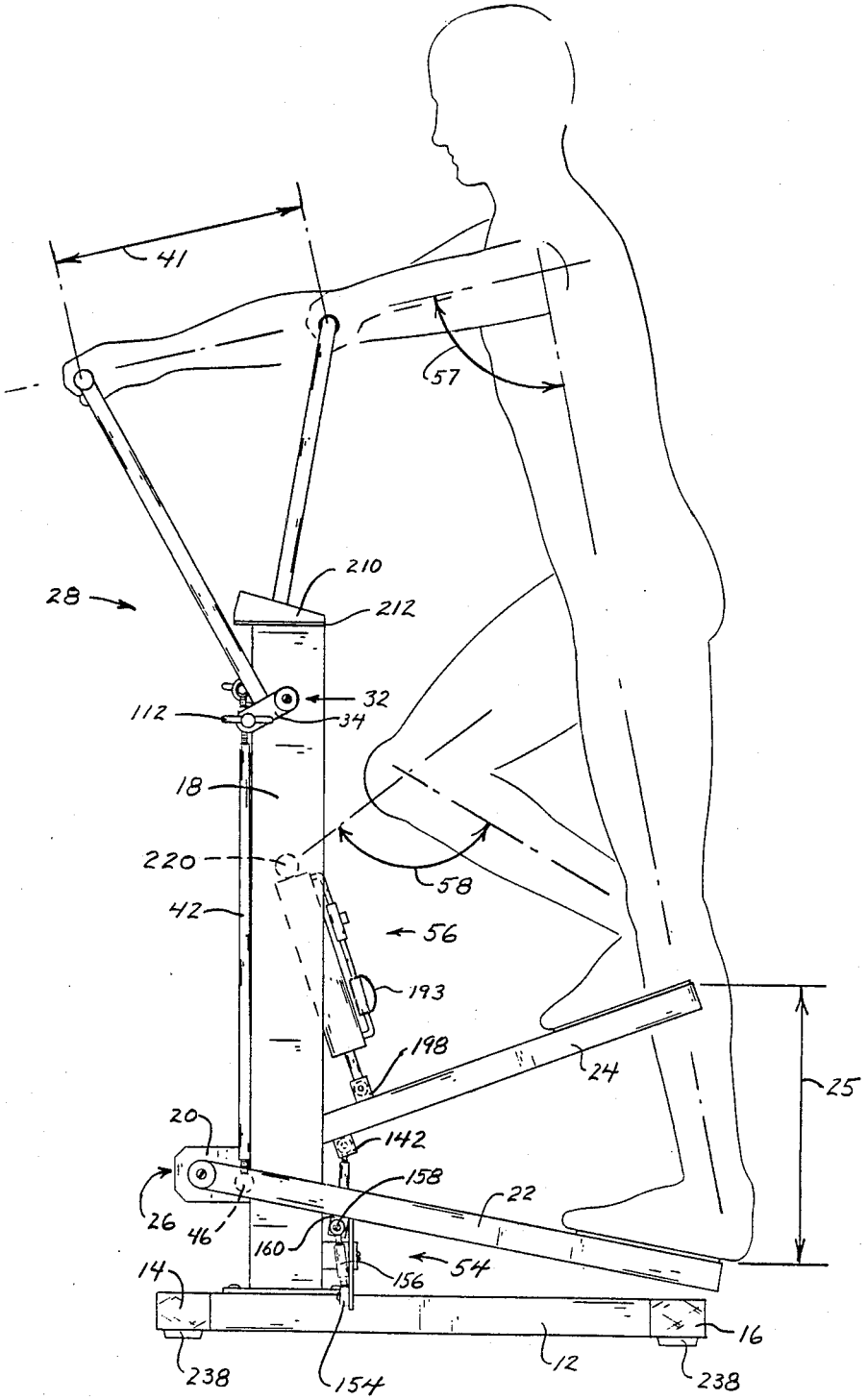
FIG. 3 is a left side elevational view of the machine of FIG. 1 showing a person using the machine.
Figure 4:
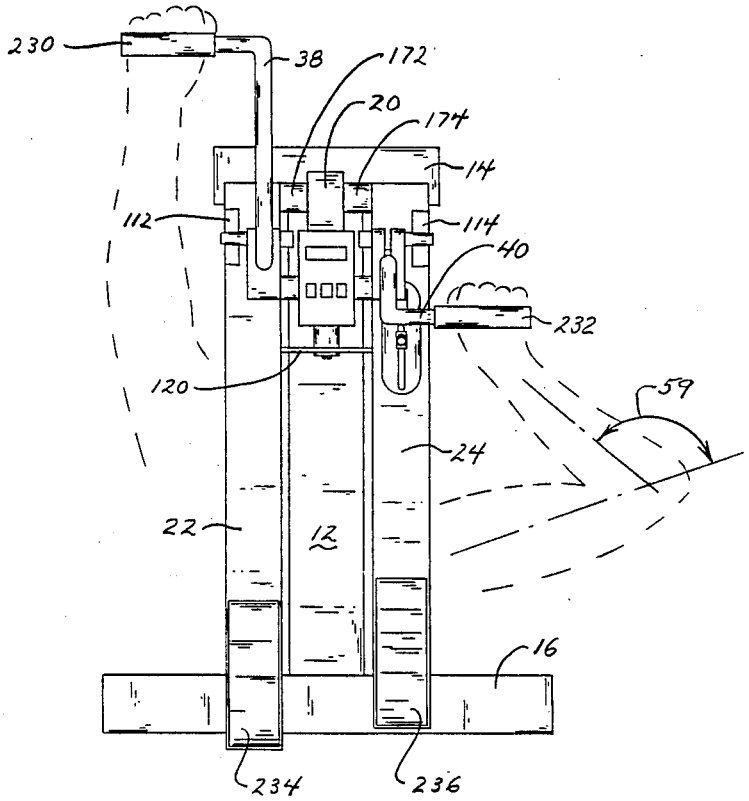
FIG. 4 is a top plan view of the machine of FIG. 1 showing the position of the user's arms when the user's legs are in the position shown in FIG. 3.

FIG. 3 shows the exercising machine with lower lever 22 in its lowest elevation which because of synchronization means 54 requires lower lever 24 to be in its highest elevation thereby defining a maximum step height denoted by distance element 25. Since tie rods 42 and 44 require the upper levers and handle bars 38 and 40 to rotate with the rotation of lower levers 22 and 24, when the maximum step height of the machine occurs there also occurs a maximum hand spread denoted by distance element 41. At the start of the cycle as shown in FIG. 3 in which the maximum step height and maximum hand spread occur, it can be seen that the left leg of the user is straight while the right leg is bent at the knee at least about a right angle as denoted by angle element 58, which is in fact about 114°. Further, while the left arm is straight or nearly straight, the right arm is bent at the elbow at least about a right angle as denoted by angle element 59 shown in FIG. 4. In fact, angle 59 is about 120°. It can also be seen that the user's left arm is extended straightly in front of the user and forms about a right angle to the user's left leg which is extended straightly downwardly as shown by angle element 57. It can be understood that the side to side reverse conditions exist at midcycle when lever 24 is at its lowest elevation and lever 22 at its highest elevation. Thus over the course of one cycle both the upper body and lower body of the user of the exercise machine of this invention are exercised by the alternate bending of the user's limbs first on one side of the body and then on the other side of the body while simultaneous causing ankle, leg, hip, back and shoulder exercise. In fact, even gentle exercise of the neck occurs naturally induced by the shifting of the user's body weight from left to right to left over the cycle. With many cycles a rhythmic motion is developed by the user operable for providing a full body exercise.

Figure 5:
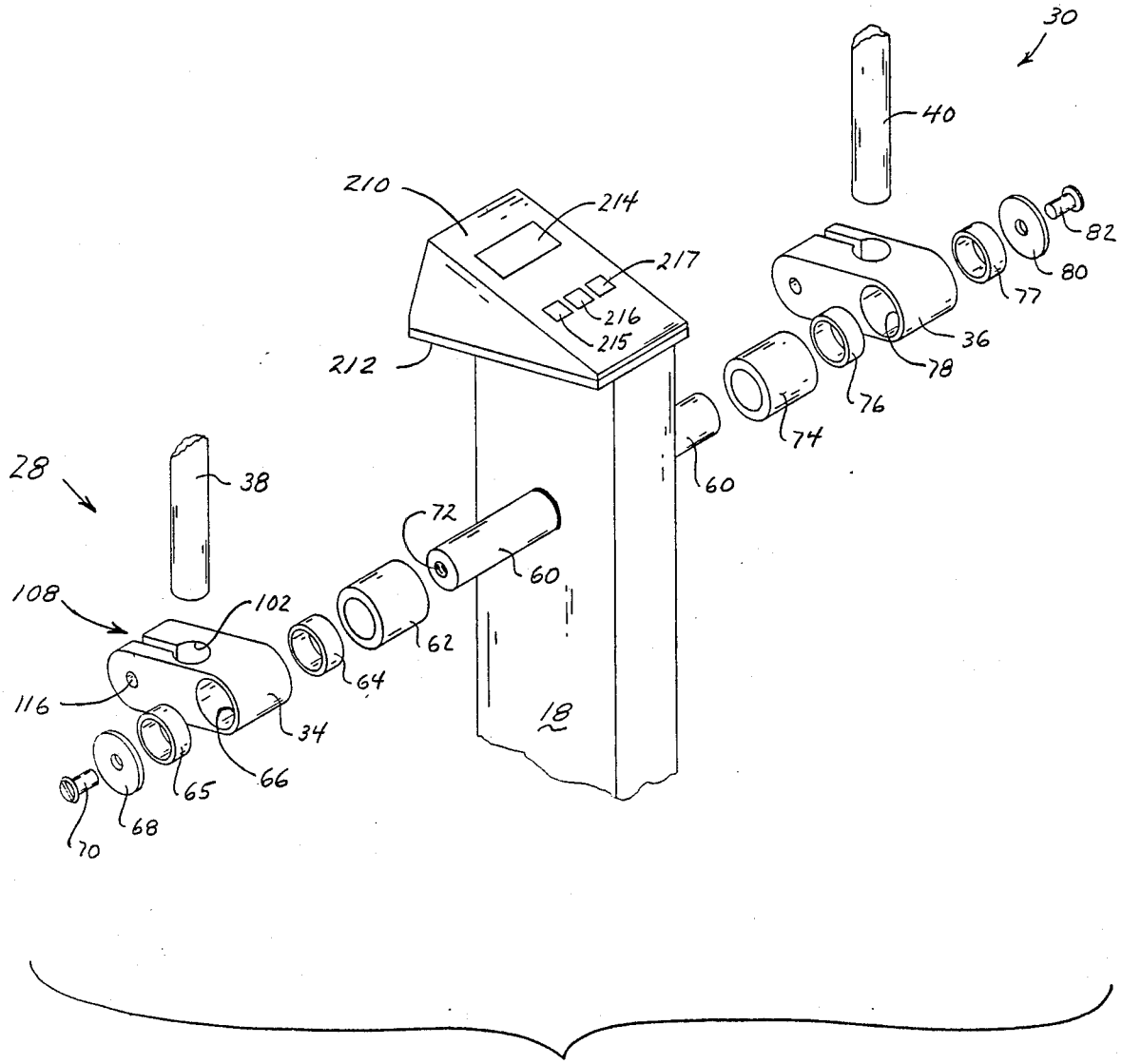
FIG. 5 is an explosive perspective view of the upper lever pivot means showing the several parts in axially alignment.

The assembly of left and right upper lever means 28 and 30 to pivot means 32 is shown in greater detail by the explosive view of FIG. 5. Shaft 60 is rigidly fastened to frame member 18 as, for example, by welding. Shaft 60 preferably extends through member 18 and is welded on each side thereof. With regard to the left side of the machine, spacer bushing 62 is slide over shaft 60 until bushing 62 abuts member 18. Sintered bronze bushings 64 and 65 are press fitted into bore 66 of lever 34 from the right and left side thereof, respectively, and then the lever is slid over shaft 60 until it abuts spacer bushing 62. Screw fastener 70 is then inserted through retaining washer 68 and fastener 70 is then screwed into internal threads 71 of shaft 60 until washer 68 is firmly abutted against lever 34. Right upper lever means 30 is mounted to the right side of shaft 60 in a similar manner and comprises spacer bushing 74, sintered bronze bushings 76 and 77 pressed into bore 78 of lever 36, washer 80 and fastener 82 which is screwed into internal threads (not shown) in the right end of shaft 60 similar to threads 72 of the left end of the shaft.

Figures 6, 7:
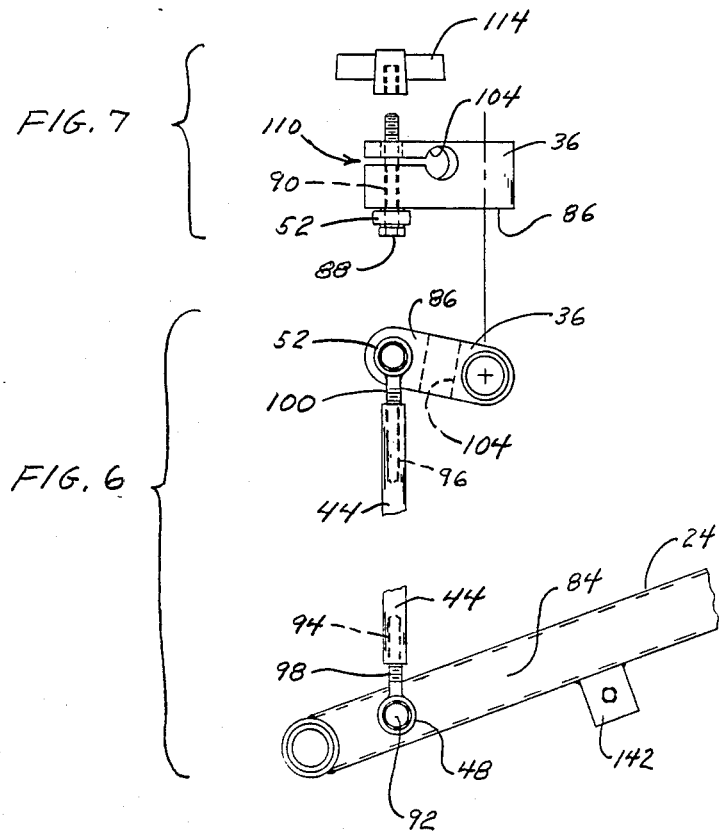
FIG. 6 is an elevational view of the right side tie rod assembly and pivotal connections to upper and lower levers of the machine of FIG. 1.
FIG. 7 is a top plan view of the upper lever and ball joint of FIG. 6 with the T-nut exploded away.

Referring now to FIGS. 6 and 7, right tie rod 44 is pivotally connected at its lower end to inside vertical surface 84 of lower lever 24 by ball joint 48 and pivotally connected at its upper end to inside vertical surface 86 of upper lever 36 by ball joint 52. Upper ball joint 52 is pivotally mounted to lever 36 by bolt 88 which is inserted through traverse bore 90 of lever 36. Lower ball joint 48 is pivotally mounted to lever 24 by fastener 92 which is screwed laterally into an internally thread bore (not shown) in vertical surface 84 of lever 24 in a manner similar to that shown in FIG. 8 with regard to fastener 148, ball joint 136 and internally threaded bore 150. Tie rod 44 contains internal threads 94 and 96 for receiving corresponding external threads 98 and 100 of ball joints 48 and 52, respectively. One of threads 98 and 100 is a right handed thread and the other a left handed thread so that the distance between ball joints 48 and 52 can be adjusted to alter the position of the free ends of handle bars 38 and 40.

Left tie rod 42 is pivotally connected to levers 22 and 34 by ball joints 46 and 50, respectively, in a similar manner as rod 44 is pivotally connected to levers 24 and 36. Tie 44 also contains internal threads similar to threads 94 and 96 of rod 44 so that the distance between ball joints 46 and 50 can be adjusted to alter the position of the free ends of handle bars 38 and 40.

Upper levers 34 and 36 contain vertical bores 102 and 104, respectively, which are adapted to slidably receive handle bars 38 and 40, respectively. Handle bars 38 and 40 are inserted into bores 102 and 104, respectively, and adjusted to a height suitable for the user as shown by dotted lines 106 in FIG. 1 for both handle bars. Levers 34 and 36 contain longitudinal slots 108 and 110, respectively. After right handle bar 40 is adjusted to the desired height in upper lever 36, T-nuts 114 is tighten onto bolt 88 enough to slightly decrease the width of slot 110 thereby tightly holding handle bar 40 at the desired height in lever 36. In a similar manner left handle bar 38 is adjusted to the desired height in lever 34 by tightening T-nut 112 on a bolt (not shown) which passes through bore 116.

Figure 8:
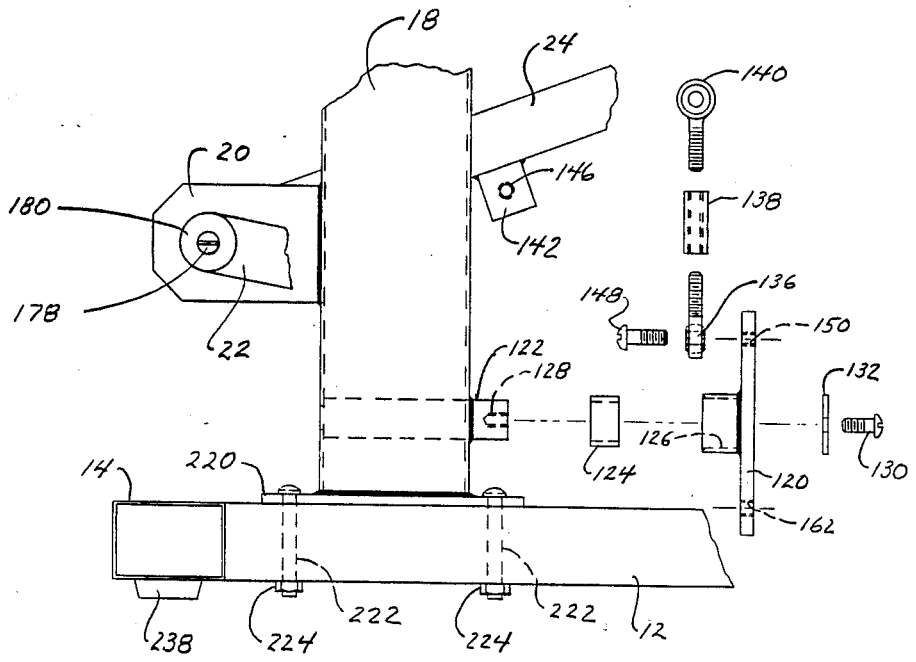
FIG. 8 is side elevational view partly broken away with the left-to-right synchronization means or rocker arm subassembly shown in exploded arrangement of the machine of FIG. 1.
Figure 9:
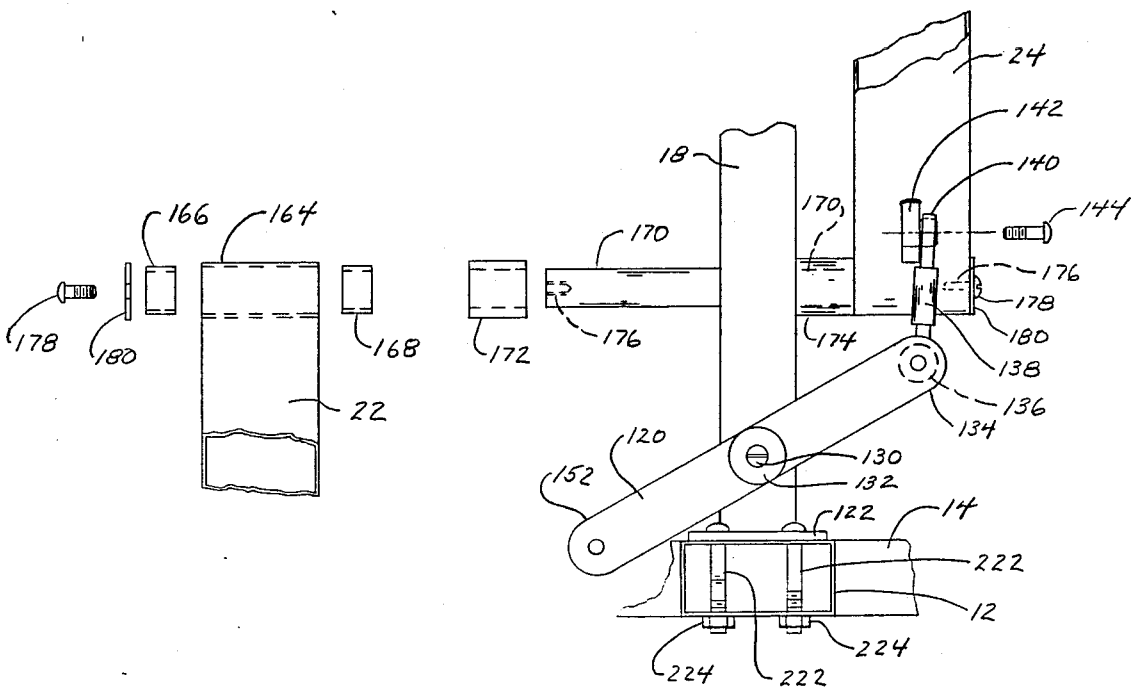
FIG. 9 is a front elevational view partly broken away of the rocker arm subassembly of FIG. 8 with the rear portion of the left lower lever shown in exploded arrangement.

The details of synchronization means 54 are shown in FIGS. 8 and 9. Synchronization means 54 comprises rocker arm 120 which is pivotally mounted on frame member 18. Shaft 122 is welded to member 18. Shaft 122 is adapted to receive sintered bronze bushing 124 which in turn is adapted to be received by internal bore 126 of rocker arm 120. Shaft 122 contains internally threaded bore 128 adapted to receive externally threaded fastener 130. After bushing 124 is pressed into bore 126, rocker arm 120 is mounted on shaft 122 and fastener 130 with washer 132 is screwed into threaded bore 128.

Right end 134 of rocker arm 120 is pivotally connected to ball joint 136 which is connected to one end of short tie rod 138, the other end of which is connected to ball joint 140. Ball joint 140 is pivotally connected to bracket 142 by externally threaded fastener 144 which is screwed into internally threaded bore 146 of bracket 142. Ball joint 136 is pivotally mounted to end 134 of rocker arm 120 by fastener 148 which is screwed into internally threaded bore 150 of rocker arm 120.

Referring to FIGS. 3 and 9, left end 142 of rocker arm 120 is pivotally connected to ball joint 154 which is connected to one end of short tie rod 156, the other end of which is connected to ball joint 158. Ball joint 158 is pivotally connected to bracket 160 which is rigidly mounted on the underside of lower lever 22. Bracket 160 contains an internally threaded bore (not shown) similar to bore 146 of bracket 142. A fastener similar to fastener 144 is used to secure ball joint 158 to bracket 160. A fastener similar to fastener 148 is used to secure ball joint 154 to internally threaded bore 162 in the left side of rocker arm 120.

Short tie rods 138 and 156 contain internal threads for receiving corresponding external threads of right side ball joints 136 and 140, and left side ball joints 154 and 158, respectively.

One end of tie rods 138 and 156 contain a right handed internal thread and the other end thereof a left handed internal thread so that the distances between ball joints 136 and 140 and ball joints 154 and 158 can be adjusted in a manner similar to that between ball joints 48 and 52 shown in FIG. 6.

The maximum step height between the free ends of lower levers 22 and 24 can be adjusted by turning tie rods 138 and 156. Since adjustment of the maximum step height will also effect the maximum hand spread, the machine should be adjusted for the maximum step height first before it is adjusted for the hand grip position.

Figure 10:
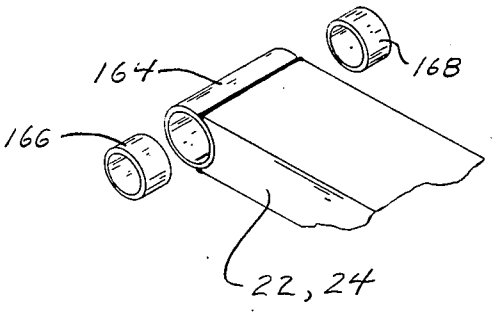
FIG. 10 is a top, front and left perspective view broken away of the rear portion of the lower levers of the machine of FIG. 1, showing in explosive arrangement the bronze bushings thereof.

FIGS. 8 to 10 also show how the lower levers 22 and 24 are pivotally mounted to frame member 20. FIG. 9 shows an explosive view of the mounting of lever 22 to member 20. As shown in FIG. 10, the pivotal ends of levers 22 and 24 contain annular sleeve 164 welded thereto. Pressed fitted into sleeve 164 are sintered bronze bearings 166 and 168. Cylindrical shaft 170 extends through member 20 and is welded thereto. Annular spacers 172 and 174 are slidably mounted on opposite sides of shaft 170 and abutted against member 20. The ends of shaft 170 contain internally threaded bores 176. Corresponding externally threaded fasteners 178 containing washers 180 are used to secure levers 22 and 24 to shaft 170. In particular, spacers 172 and 174 are first slide over shaft 170 from the left and right side, respectively. Then lower levers 22 and 24 each contain sleeve 164 which contains a pair of pressed fitted sintered bronze bearings 166 and 168, are slid over shaft 170 and abutted against spacers 172 and 174, respectively. Then fasteners 178 with washers 180 are screwed into bores 176 thereby securing the levers in a pivotal relationship to frame member 20.

Resistance means 56 comprises hydraulic cylinder 190, tubing 192 which contains flow control needle valve 194, piston rod 196, bracket 198, extension frame member 200, upper mount 202 and bearing or lower mount 204. Preferably hydraulic cylinder 190 contains an hydraulic fluid which experience very little viscosity change with temperature such as ATF type F fluid so that resistance to fluid flow through needle valve 194 remains constant throughout the workout period of the user. Hydraulic cylinder 190 can be mounted with piston rod 196 attached to bracket 198 as shown in the figures or inverted with piston rod 196 attached to upper mount 202.

Plate 212 is rigidly mounted to the top of frame member 18 and serves as a platform for mounting console 210. Console 210 preferably contains digital displays of user time, total steps, steps per minute and reset buttons therefor. In one embodiment, the console is microprocessor controlled with liquid crystal display 214 with touch sensitive membrane switch controls such as start/stop 215, mode 216 and reset 217 buttons. In another embodiment, console 210 also contains a jack for a pulse sensor and digital display of user present pulse rate.

Handle bars 38 and 40 preferably are fitted with hand grips 230 and 232, respectively, made from an elastic material such as vinyl or rubber. Similarly lower levers 22 and 24 preferably are fitted with high friction surfaces 234 and 236, respectively, made from an elastic material such as rubber and containing a ribbed upper surface to prevent the user's shoes from slipping off of the levers during use.

Attachment of frame members 14 and 16 to frame member 12 and attachment of frame member 20 to frame member 18 are preferably by welding. However, to facilitate shipping of the exercising machine in smaller containers, it is preferable to attach member 18 to member 12 by four bolts as shown in FIGS. 8 and 9. Preferably member 18 has rectangular plate 220 welded to the bottom thereof with four openings in the corners of plate 220 adapted to receive four bolts 222 which extend through plate 220 and the top and bottom of member 12 and secured by four nuts 224.

Preferably near each ends of the under-surface of frame members 14 and 16 there is attached non-skid elastic mounts 238 operable for preventing movement of the machine along its resting surface and damage thereto.

Preferably frame members 12 and 18 are made from 2-inch and 4-inch cold rolled electric welded ("CREW") rectangular steel tubing having a wall thickness of about 0.065 to about 0.083 inches; however, thinner wall thickness can be used if desired. Preferably frame members 14, 16 and 20 are made from 2 inch by 3 inch CREW rectangular steel tubing having a wall thickness of about 0.065 to about 0.083 inches; however, thinner wall thickness can be used if desired. Preferably lower levers 22 and 24 are made from 1.5 inch by 3 inch CREW rectangular steel tubing having a wall thickness of about 0.095 to about 0.120 inch; however, thinner wall thicknesses can be used if desired. Ball joints are preferably male rod spherical ball rod end. A non-limiting example of such ball joint pairs are Boston Gear catalog no. M-6CR and ML-6CR which have a $\frac{3}{8}$—24 UNF external thread. Tie rods 38, 40, 138 and 156 are preferably $\frac{5}{8}$ inch steel tubing with male internal threads at one end and female internal threads at the other end. Alternately hexagonal or square stock can be used if desired. Upper levers 34 and 36 are preferably made from aluminum. Handle bars 38 and 40 are preferably $\frac{7}{8}$ inch O.D., 0.065 inch wall thickness polished stainless steel tube. Plates 212 and 220 are preferably $\frac{1}{4}$ inch steel plate. Shafts 60, 128 and 170 are preferably 1.0 inch cold rolled steel, taped in free ends and welded in place as described above. Rocker arm 120 is preferably $\frac{3}{8}$ inch steel plate with welded bearing housing. Sintered bronze bushings 64, 65, 76, 77, 124, 166 and 168 are preferably 1.0 inch ID, 1.25 inch OD, such as Boston Gear B1620-6. Cylindrical sleeve 164 is preferably steel tubing drawn over mandrel for high precision inside diameter. Washers 68, 80, 132 and 180 and spacers 62, 64 and 172 are preferably made from a polymer acetyl resin plastic such as Delrin branch plastic. For appearance purposes, bolts 122 are preferably button head bolts.

Hydraulic cylinder 190 is preferably 1.5 inch bore, 6 inch stroke such as Bimba "500" hydraulic cylinder part no. H-176-DUZ. An example of flow control needle valve 194 if Rego part no. MN 250B.

In another embodiment, a small accumulator, 193 (shown in FIG. 3) is contained in line 192 to take up and release hydraulic fluid to compensate for unequal displacement of hydraulic fluid on opposite sides of the hydraulic cylinder piston caused by the presence of a piston rod on one side of the piston. Preferably the accumulator has an elastic diaphragm to isolate the gas side thereof from the hydraulic fluid side thereof so that gas does not become mixed with the hydraulic fluid. Preferable the accumulator is on the piston rod side of valve 194 so that all displaced hydraulic fluid is forced through valve 194.

Figure 11:
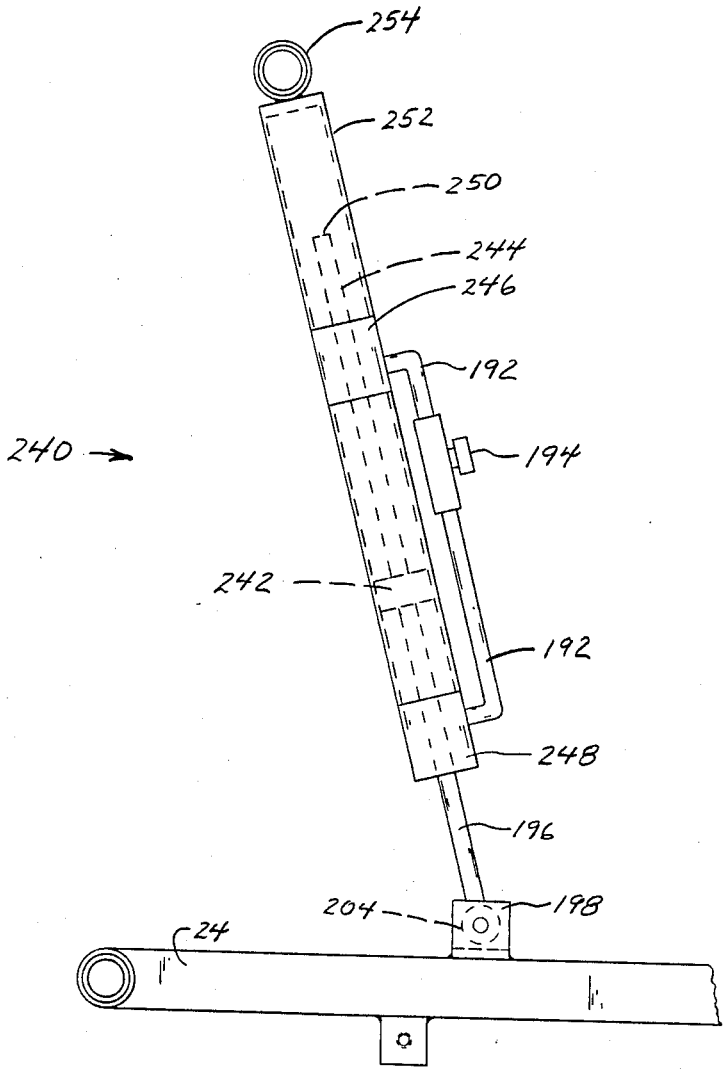
FIG. 11 is left side elevational view of another embodiment of the resistance means which utilizes a double rod end hydraulic cylinder.

In an especially preferred embodiment as shown in FIG. 11, hydraulic cylinder 190 is replaced with hydraulic cylinder 240 which has a piston rod which extends through both ends of the cylinder so that the volume displaced on one side of the piston equals the volume increase on the other side of the piston. In particular, cylinder 240 contains a conventional piston 242 and piston rod 196 but also an opposite piston rod 244 which passes through and is in slidable sealable relationship with cylinder head 246 in the same manner as piston rod 196 is in slidable sealable relationship with opposite cylinder head 248. Piston rod 248 has free end 250 which is at all times outside of head 246 regardless of the position of piston 242 between heads 246 and 248. Upper piston rod 244 is housed in cover member 252 which is rigidly attached to head 246 and eye mount 254. Eye mount 254 is pivotally attached to extension frame member 200 and lower eye mount 204 pivotally attached to bracket 198. By having exactly equal displacements on both sides of piston 242, equal resistance in compression and tension is achieved. In other words, the force required to move left lower lever 22 down, which places cylinder 240 in compression, is equal to the force required to move right lower lever 24 down, which places cylinder 240 in tension. Furthermore, no air or gas zone is required in double rod cylinder 240, nor alternatively an accumulator, to compensate for unequal displacements on opposite sides of the piston as is required in single rod cylinder 190. Use of an air or gas zone internally in cylinder 190 or alternatively use of an accumulator can cause a certain amount of springiness in the resistance provided by the hydraulic cylinder when the cylinder is first placed in compression and tension at the start of a cycle or midcycle, that is whenever the direction of the lower levers is reversed. Furthermore, direct contact of the air or gas zone with the hydraulic fluid can in some circumstances result in emulsification of the hydraulic fluid particularly when the machine is operated at a high cycle frequency.

The housing of hydraulic cylinders 190 and 240 can be steel tubing or extruded aluminum with external fins to increase the surface area for heat dissipation and a hard anodized inside diameter for wear resistance and durability. The piston seal is preferably an U-cup seal. Heads 246 and 248 contain a rod bearing, a rod wiper and a rod seal at each rod port.

By using ball joints for all tie rods, sintered bronze bushings, and an hydraulic cylinder for the resistance means, the preferred embodiment of the exercising machine of this invention is whisper quiet when in use and as such can be enjoyed in an user's apartment without disturbing residents in adjacent apartments. Because the whisper quiet nature of the exercising machine the user can listen to television or stereo simultaneously while exercising without having to turn the sound up to compensate for noise produced by the machine. Whereas exercising machines using chains, gears or weights are relatively noisy when used and relatively messy because of the lubricating grease, the exercising machine of this invention can be safely used and housed in the user's living quarters rather than the garage, basement or gymnasium.

While the preferred embodiments of the present invention have been described, it should be understood that various changes, adaptations and modifications may be made thereto without departing from the spirit of the invention and the scope of the appended claims. It should be understood, therefore, that the invention is not to be limited to minor details of the illustrated invention shown in the figures and that variations in such minor details will be apparent to one skilled in the art.

Therefore it is to be understood that the present disclosure and embodiment of this invention described herein are for purposes of illustration and example and that modifications and improvements may be made thereto without departing from the spirit of the invention or from the scope of the claims. The claims, therefore, are to be accorded a range of equivalents commensurate in scope with the advances made over the art.

What is claimed is:

1. An exercising machine having a cycle for the full body exercise of the human body in which at all times the user remains in an upright standing position, such full body exercise simulating climbing motion of the user's legs with synchronized push-pull motion of the user's arms, whereby at the start of the cycle with the user's body weight shifted to the right side of said machine, the user's right limbs are fully extended with the user's right arm in front of the user and at about a right angle to the user's right leg, and the user's left limbs are bent with the user's left leg being bent at the knee at least about a right angle and the user's left arm being bent at the elbow at least about a right angle, whereby shifting of the user's body weight to the left side of said machine commences bending of the user's right limbs and straightening of the user's left limbs such that at mid cycle of said machine the user's left limbs are fully extended with the user's left arm in front of the user and at about a right angle to the user's left leg, and the user's right limbs are bent with the user's right leg being bent at the knee at least about a right angle and the user's right arm being bent at the elbow at least about a right angle, whereby at mid-cycle of said machine, shifting of the user's body weight back to the right side of said machine commences bending of the user's left limbs and straightening of the user's right limbs such that at the end of the cycle of said machine the user's right limbs are fully extended with the user's right arm in front of the user and about a right angle to the user's right leg, and the user's left limbs are bent with the user's left leg being bent at the knee at least about a right angle and the user's left arm being bent at the elbow at least about a right angle, said full body exercising machine comprising:

a base member operable for maintaining said machine in an upright standing position;

a vertical frame member fixedly attached to said base member proximate the rearward end thereof;

right and left lower levers pivotally mounted on the lower part of said vertical frame member at a lower pivot point and horizontally and forwardly extending therefrom, the free ends of said right and left lower levers being operable for standing on by user's right and left feet, respectively;

right and left upper levers means pivotally mounted on the upper part of said vertical frame member at an upper pivot point and horizontally and rearwardly extending therefrom, said right and left upper lever means having right and left hand grips, respectively;

right and left tie rods pivotally mounted at the upper distal ends thereof to said right and left upper lever means, respectively, and pivotally mounted at the lower distal ends thereof to said right and left lower levers, respectively, such that rotation of said lower lever on either side of said machine in one direction causes rotation of said upper lever means on the same side of said machine in an opposite direction, whereby when the free ends of either of said lower levers is at its lowest elevation, said hand grip of said upper lever means on the same side of said machine is at its farthest rearward position, and whereby when the free end of either of said lower levers is at its highest elevation, said hand grip of said upper lever means on the same side of said machine is at its farthest forward position;

means for synchronizing the movement of said lower levers, said means being operable when one of said lower levers is moving downwardly to cause the other one of said lower levers to move upwardly, and when the free end of one of said lower levers is at its lowest elevation the free end of the other one of said lower levers is at its highest elevation, the distance between the free ends of said lower levers when one of said lower levers is at its lowest elevation defining a maximum step height, and the distance between said hand grips when one of said hand grips is at its farthest forward position defining a maximum hand spread, said lower levers being operable to effect a maximum step height large enough to cause one of the user's legs to be bent at the knee at least about a right angle when the other one of the user's legs is straight, said upper lever means being operable to effect a maximum hand spread large enough to cause one of the user's arms to be bent at the elbow at least about a right angle when the other one of the user's arms is straight; and resistance means for resisting the movement of said right and left lower levers, whereby travel of the free end of one of said lower levers from its lowest elevation to its highest elevation and thence back to its lowest elevation defines a full cycle, whereby when an user stands on the free ends of said lower levers and tightly grips said hand grips, while causing said machine to complete said full cycle, the user experiences a full body exercise simulating climbing motion of the user's legs with synchronized push-pull motion of the user's arms.

2. An exercising machine having a cycle for the full body exercise of the human body in which at all times the user remains in an upright standing position, such full body exercise simulating climbing motion of the user's legs with synchronized push-pull motion of the user's arms, whereby at the start of the cycle with the user's body weight shifted to the right side of said machine, the user's right limbs are fully extended with the user's right arm in front of the user and at about a right angle to the user's right leg, and the user's left limbs are bent with the user's left leg being bent at the knee at least about a right angle and the user's left arm being bent at the elbow at least about a right angle, whereby shifting of the user's body weight to the left side of said machine commences bending of the user's right limbs and straightening of the user's left limbs such that at mid cycle of said machine the user's left limbs are fully extended with the user's left arm in front of the user and at about a right angle to the user's left leg, and the user's right limbs are bent with the user's right leg being bent at the knee at least about a right angle and the user's right arm being bent at the elbow at least about a right angle, whereby at mid-cycle of said machine, shifting of the user's body weight back to the right side of said machine commences bending of the user's left limbs and straightening of the user's right limbs such that at the end of the cycle of said machine the user's right limbs are fully extended with the user's right arm in front of the user and about a right angle to the user's right leg, and the user's left limbs are bent with the user's left leg being bent at the knee at least about a right angle and the user's left arm being bent at the elbow at least about a right angle, said full body exercising machine comprising:

a base member operable for maintaining said machine in an upright standing position;

a vertical frame member fixedly attached to said base member proximate the rearward end thereof;

right and left lower levers pivotally mounted on the lower part of said vertical frame member at a lower pivot point and horizontally and forwardly extending therefrom, the free ends of said right and left lower levers being operable for standing on by user's right and left feet, respectively;

right and left upper levers pivotally mounted on the upper part of said vertical frame member at an upper pivot point and horizontally and rearwardly extending therefrom;

right and left tie rods pivotally mounted at the upper distal ends thereof to said right and left upper levers, respectively, and pivotally mounted at the lower distal ends thereof to said right and left lower levers, respectively, such that rotation of said lower lever on either side of said machine in one direction causes rotation of said upper lever on the same side of said machine in an opposite direction;

right and left handle bars fixedly mounted on said right and left upper levers, respectively, said handle bars extending vertically from said upper levers, the free ends of said right and left handle bars being operable for being tightly gripped by an user's right and left hands, respectively, whereby when the free ends of either of said lower levers is at its lowest elevation, the free end of said handle bar on the same side of said machine is at its farthest rearward position, and whereby when the free end of either of said lower levers is at its highest elevation, the free end of said handle bar on the same side of said machine is at its farthest forward position;

means for synchronizing the movement of said lower levers, said means being operable when one of said lower levers is moving downwardly to cause the other one of said lower levers to move upwardly, and when the free end of one of said lower levers is at its lowest elevation the free end of the other one of said lower levers is at its highest elevation.

the distance between the free ends of said lower levers when one of said lower levers is at its lowest elevation defining a maximum step height, and the distance between the free ends of said handle bars when one of said handle bars is at its farthest forward position defining a maximum hand spread, said lower levers being operable to effect a maximum step height large enough to cause one of the user's legs to be bent at the knee at least about a right angle when the other one of the user's legs is straight, said upper levers is combination with said handle bars being operable to effect a maximum hand spread large enough to cause one of the user's arms to be bent at the elbow at least about a right angle when the other one of the user's arms is straight; and resistance means for resisting the movement of said right and left lower levers, one end of said resistance means being pivotally mounted on the upper part of said vertical frame member and another end of said resistance means being pivotally mounted on one of said lower levers, whereby travel of the free end of one of said lower levers from its lowest elevation to its highest elevation and thence back to its lowest elevation defines a full cycle, · whereby when an user stands on the free ends of said lower levers and tightly grips the free ends of said handle bars, while causing said machine to complete said full cycle, the user experiences a full body exercise simulating climbing motion of the user's legs with synchronized push-pull motion of the user's arms.

3. The machine of claim 2, wherein said maximum step height is at least about 25 centimeters and said maximum hand spread is at least about 50 centimeters.

4. The machine of claim 2, wherein said synchronizing means is adjustable and operable to vary said maximum step height.

5. The machine of claim 2, wherein said synchronizing means comprises a rocker arm and right and left linking rods, said rocker arm having right and left ends and pivotally mounted at its center to said vertical frame member thereby enabling it to rotate in a traverse plane which is approximately vertical, said right linking rod having one end pivotally mounted to said right lower lever and an opposite end pivotally mounted to said right end of said rocker arm, said left linking rod having one end pivotally mounted to said left lower lever and an opposite end pivotally mounted to said left end of said rocker arm.

6. The machine of claim 5, wherein said linking rods have an effective length which can be adjusted to predetermined values thereby enabling said maximum step height to be adjusted to corresponding predetermined values.

7. The machine of claim 2, wherein said resistance means is adjustable and operable for varying the force required to move said lower levers.

8. The machine of claim 2, wherein said resistance means comprises a hydraulic cylinder having a slidable piston therein connected to a piston rod, said piston dividing said hydraulic cylinder into an internal upper zone above said piston and an internal lower zone below said piston, and a conduit containing a flow restrictor, said conduit providing fluid communication between said upper and lower zones of said hydraulic cylinder, the external end of said piston rod being one end of said resistance means and the external end of said hydraulic cylinder opposite said piston rod being an opposite end of said resistance means.

9. The machine of claim 8, wherein said flow restrictor is adjustable and operable for varying the force required to move said lower levers.

10. The machine of claim 9, wherein said flow restrictor is a needle valve.

11. An exercising machine having a cycle for the full body exercise of the human body in which at all times the user remains in an upright standing position, such full body exercise simulating climbing motion of the user's legs with synchronized push-pull motion of the user's arms, said full body exercising machine comprising:

a base member operable for maintaining said machine in an upright standing position;

a vertical frame member fixedly attached to said base member proximate the rearward end thereof;

right and left lower levers pivotally mounted on the lower part of said vertical frame member at a lower pivot point and horizontally and forwardly extending therefrom, the free ends of said right and left lower levers being operable for standing on by user's right and left feet, respectively;

right and left upper levers pivotally mounted on the upper part of said vertical frame member at an upper pivot point and horizontally and rearwardly extending therefrom;

right and left tie rods pivotally mounted at the upper distal ends thereof to said right and left upper levers, respectively, and pivotally mounted at the lower distal ends thereof to said right and left lower levers, respectively, such that rotation of said lower lever on either side of said machine in one direction causes rotation of said upper lever on the same side of said machine in an opposite direction;

right and left handle bars fixedly mounted on said right and left upper levers, respectively, said handle bars extending vertically from said upper levers, the free ends of said right and left handle bars being operable for being tightly gripped by an user's right and left hands, respectively, whereby when the free ends of either of said lower levers is at its lowest elevation, the free end of said handle bar on the same side of said machine is at its farthest rearward position, and whereby when the free end of either of said lower levers is at its highest elevation, the free end of said handle bar on the same side of said machine is at its farthest forward position;

means for synchronizing the movement of said lower levers, said means being operable when one of said lower levers is moving downwardly to cause the other one of said lower levers to move upwardly, and when the free end of one of said lower levers is at its lowest elevation the free end of the other one of said lower levers is at its highest elevation, the distance between the free ends of said lower levers when one of said lower levers is at its lowest elevation defining a maximum step height, and the distance between the free ends of said handle bars when one of said handle bars is at its farthest forward position defining a maximum hand spread, said lower levers being operable to effect a maximum step height large enough to cause one of the user's legs to be bent at the knee at least about a right angle when the other one of the user's legs is straight, said upper levers is combination with said handle bars being operable to effect a maximum hand spread large enough to cause one of the user's arms to be bent at the elbow at least about a right angle when the other one of the user's arms is straight; and resistance means for resisting the movement of said right and left lower levers, whereby travel of the free end of one of said lower levers from its lowest elevation to its highest elevation and thence back to its lowest elevation defines a full cycle, whereby when an user stands on the free ends of said lower levers and tightly grips the free ends of said handle bars, while causing said machine to complete said full cycle, the user experiences a full body exercise simulating climbing motion of the user's legs with synchronized push-pull motion of the user's arms.

12. The machine of claim 11, wherein said maximum step height is at least about 25 centimeters and said maximum hand spread is at least about 50 centimeters.

13. The machine of claim 11, wherein said synchronizing means is adjustable and operable to vary said maximum step height.

14. The machine of claim 11, wherein said synchronizing means comprises a rocker arm and right and left linking rods, said rocker arm having right and left ends and pivotally mounted at its center to said vertical frame member thereby enabling it to rotate in a traverse plane which is approximately vertical, said right linking rod having one end pivotally mounted to said right lower lever and an opposite end pivotally mounted to said right end of said rocker arm, said left linking rod having one end pivotally mounted to said left lower lever and an opposite end pivotally mounted to said left end of said rocker arm.

15. The machine of claim 14, wherein said linking rods have an effective length which can be adjusted to predetermined values thereby enabling said maximum step height to be adjusted to corresponding predetermined values.

16. The machine of claim 11, wherein said resistance means is adjustable and operable for varying the force required to move said lower levers.

17. The machine of claim 11, wherein one end of said resistance means is pivotally mounted on the upper part of said vertical frame member and another end of said resistance means is pivotally mounted on one of said lower levers.

18. The machine of claim 17, wherein said resistance means comprises a hydraulic cylinder having a slidable piston therein connected to a piston rod, said piston dividing said hydraulic cylinder into an internal upper zone above said piston and an internal lower zone below said piston, and a conduit containing a flow restrictor, said conduit providing fluid communication between said upper and lower zones of said hydraulic cylinder, the external end of said piston rod being being one end of said resistance means and the external end of said hydraulic cylinder opposite said piston rod being an opposite end of said resistance means.

19. The machine of claim 18, wherein said flow restrictor is adjustable and operable for varying the force required to move said lower levers.

20. The machine of claim 19, wherein said flow restrictor is a needle valve.

* * * * *